US005246063A

United States Patent [19]

Fix et al.

[11] Patent Number: 5,246,063

[45] Date of Patent: Sep. 21, 1993

[54] HEAT EXCHANGER FOR COOLING SYNTHESIS GAS GENERATED IN A COOL-GASIFICATION PLANT

[75] Inventors: Michael Fix; Konrad Nassauer, both of Berlin; Rainer Gadow, Aschau, all of Fed. Rep. of Germany

[73] Assignee: Deutsche Babcock-Borsig AG, Berlin, Fed. Rep. of Germany

[21] Appl. No.: 931,822

[22] Filed: Aug. 18, 1992

[30] Foreign Application Priority Data

Apr. 29, 1992 [NL] Netherlands ..... 92107283

[51] Int. Cl.[5] ..... F28F 19/00

[52] U.S. Cl. ..... 165/134.1; 165/133

[58] Field of Search ..... 165/134.1, 133

[56] References Cited

U.S. PATENT DOCUMENTS

| | | | |
|---|---|---|---|
| 3,150,714 | 9/1964 | Jacobs et al. | 165/134.1 |
| 3,185,210 | 5/1965 | Kuhne et al. | 165/134.1 |
| 3,707,186 | 12/1972 | Zorrilla et al. | 165/134.1 |
| 4,254,819 | 3/1981 | Worrell | 165/134.1 |
| 4,294,312 | 10/1981 | Kehrer et al. | 165/134.1 |
| 4,585,057 | 4/1986 | Marburger | 165/134.1 |
| 4,706,743 | 11/1987 | Chalimbaud | 165/134.1 |
| 4,750,553 | 6/1988 | Pohl et al. | 165/134.1 |

FOREIGN PATENT DOCUMENTS

| | | | |
|---|---|---|---|
| 1185420 | 1/1965 | Fed. Rep. of Germany | 165/134.1 |
| 36228 | 10/1971 | Japan | 165/134.1 |
| 817396 | 3/1981 | U.S.S.R. | 165/134.1 |
| 1259111 | 1/1972 | United Kingdom | 165/134.1 |

*Primary Examiner*—Martin P. Schwadron
*Assistant Examiner*—L. R. Leo
*Attorney, Agent, or Firm*—Max Fogiel

[57] ABSTRACT

A heat exchanger for cooling synthesis gas generated in a coal-gasification plant has heat-transfer pipes (1) that the gas flows through, that are secured in two slabs (2 & 3) of piping, and that are enclosed in a jacket (4). The gas intake-end piping slab (2) is protected by a layer of ceramic flooring. The flooring consists of adjacent block-shaped sockets (12), each of which has an opening (15) that tapers together conically into a pipe section (14) that extends into one of the pipes (1).

7 Claims, 3 Drawing Sheets

HEAT EXCHANGER FOR COOLING SYNTHESIS GAS GENERATED IN A COOL-GASIFICATION PLANT

BACKGROUND OF THE INVENTION

The invention concerns a heat exchanger, for cooling synthesis gas generated in a coal-gasification plant.

The synthesis gas that derives from the gasification of coal contains such components as particles of ash that lead to erosion and sulphur compounds that lead to high-temperature corrosion of the piping slaps and piping intake. Protecting the gas-intake end of a heat-sink heat exchanger by enclosing it in a ceramic monolith and extending intake tubes through the monolith and up to the piping intake is known from the synthesis of ammonia (Chem.-Ing.-Tech. 56 [1984], pp. 356–58).

SUMMARY OF THE INVENTION

The object of the present invention is to effectively protect the gas-intake end of the generic heat exchanger against high-temperature corrosion and erosion by measures appropriate for cooling the synthesis gas that derives from a coal-gasification plant.

The sockets can be made from a ceramic distinguished for high resistance to variations in temperature and to erosion. The sockets function as a conical extension of the piping intake and when installed constitute a continuous flooring over and accordingly protecting the piping slab including the intake. The sockets' particular conical intake section prevents the solid particles in the synthesis gas from caking up into bridges that would clog it up. The conicity continuously accelerates the synthesis gas and the particles suspended in it, preventing them from depositing. The double coating on the piping slab and welded joint and inside the piping intake renders these components very resistant to high-temperature corrosion and erosion. The protection is activated when a socket is destroyed.

BRIEF DESCRIPTION OF THE DRAWINGS

One embodiment of the invention will now be specified with reference to the drawing, wherein.

DESCRIPTION OF THE PREFERRED EMBODIMENTS

Figure 1:
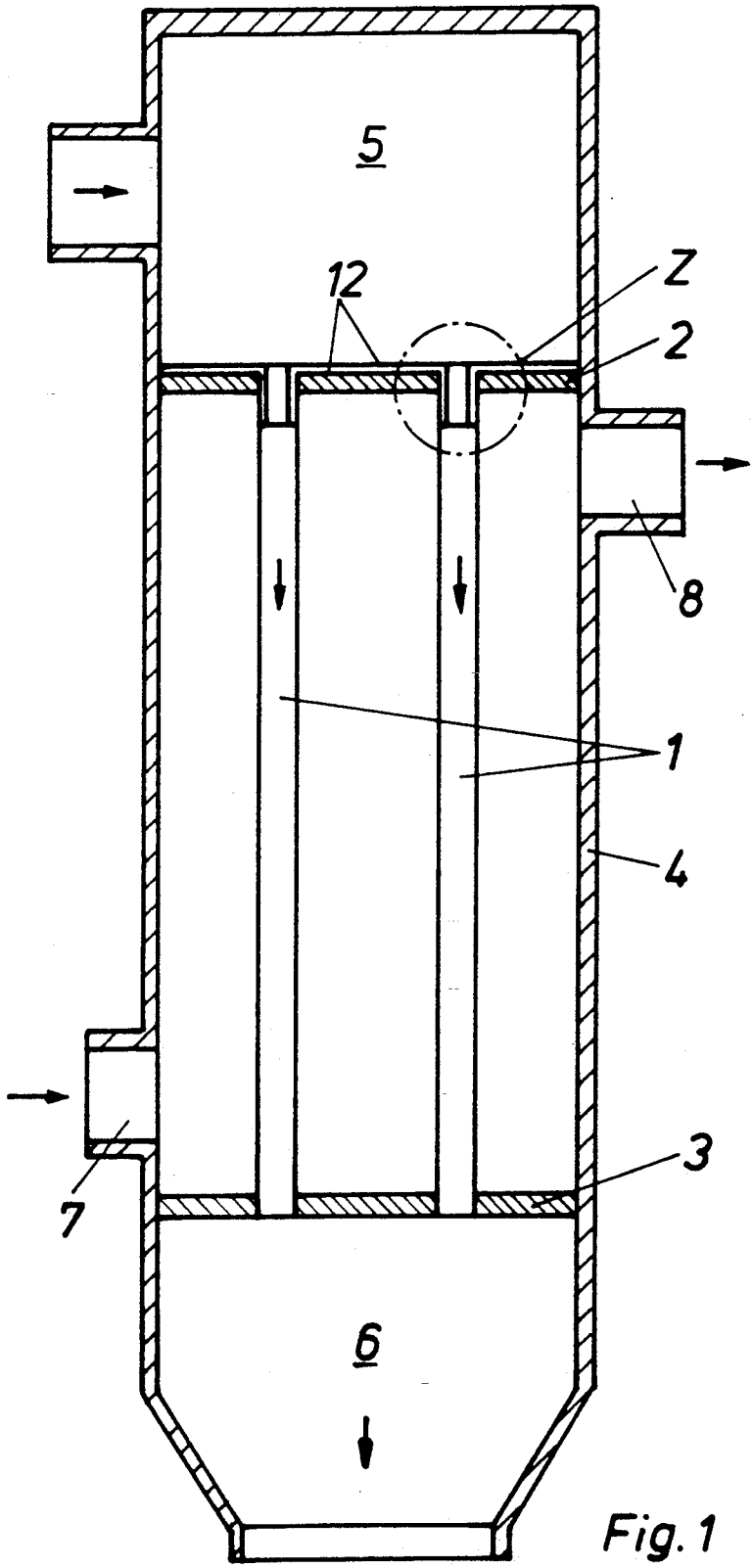
FIG. 1 is a longitudinal section through a heat exchanger.
Figure 2:
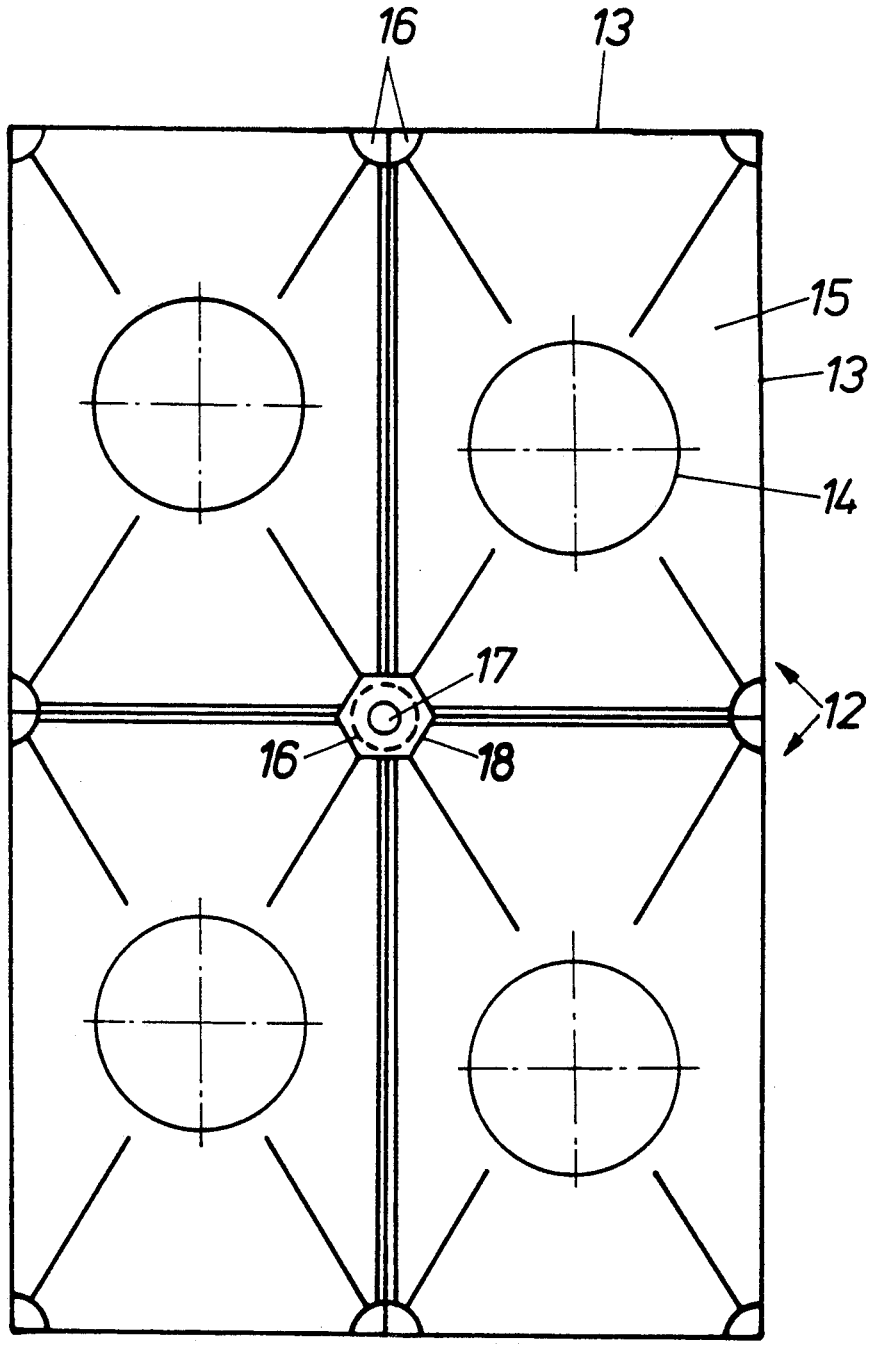
FIG. 2 is a top view of part of the gas intake-end piping slab.

A heat exchanger has a sheaf of heat-transfer pipes 1, two of which are illustrated. Pipes 1 are secured at each end in piping slabs (tube sheets) 2 and 3. The slabs are in turn secured in a jacket 4 that surrounds pipes 1. Inside jacket 4, a gas-intake chamber 5 communicates with piping slab 2, which is at the top of the figure, and a gas-outlet chamber 6 with piping slab 3, which is at the bottom. Gas-intake chamber 5 also communicates through an unillustrated pipeline with an also unillustrated reactor, wherein coal is gasified. The resulting synthesis gas enters gas-intake chamber 5, loses heat as it flows through pipes 1 and emerges cool from gas-intake chamber 6.

The heat exchanger's jacket 4 has an intake connector 7 and an outlet connector 8. A coolant in the form of water is introduced into jacket 4 through intake connector 7. The water vaporizes with the heat from the gas flowing through pipes 1 and leaves in the form of a mixture of steam through outlet connector 8. The steam mixture is supplied to the steam drum of an unillustrated steam-generating system.

Pipes 1 are composite pipes with an austenitic lining 9 that counteracts high-temperature corrosion on the part of the hot synthesis gas. Lining 9 is snugly accommodated in an outer sleeve 10. Sleeve 10 is secured in piping slab 2 by a weld 11.

The gas intake-end piping slab 2 is protected against high-temperature corrosion and erosion where it communicates with gas-intake chamber 5 by a solid layer comprising several ceramic sockets 12. The top of each socket 12 is a rectangular block 13 that tapers together downward and terminates in a section 14 of pipe. The opening 15 through each socket 12 tapers conically in from block 13 to the open cross-section of pipe section 14. Since the outside diameter of the pipe section 14 of socket 12 is slightly smaller than the inside diameter of pipe 1, section 14 can be inserted into the intake of pipe 1. Pipe section 14 extends far enough into the intake of pipe 1 for its lower edge to overlap lining 9.

Sockets 12 are positioned against piping slab 2 with a pipe section 14 inserted in each pipe 1 and blocks 13 resting one against another some distance above piping slab 2. The result is a continuous flooring over and protecting the whole gas intake-end piping slab 2.

Each corner of a socket 12 provided with a quarter-circle cross-section fluting 16. A bolt 17 extends through the bore constituted by the combined fluting 16 of four sockets and is secured to piping slab 2. Sockets 12 are secured to piping slab 2 by nuts 18 threaded over bolts 17.

Piping slab 2 and its weld 11 to pipe 1 are covered with two layers of coating 20. The first layer is a metal deposit atmospherically plasma-sputtered to the metal of piping slab 2. It protects the material against oxidation and high-temperature corrosion and promotes adhesion on the part of the second layer. The second layer is an atmospherically plasma-sputtered layer of ceramic that is resistant to high-temperature corrosion and erosion. Coating 20 is also applied inside the intakes into pipes 1 to counteract the increased exposure to erosion and heat at that point resulting from turbulence in their turbulent sections, especially at the end of socket 12.

Figure 3:
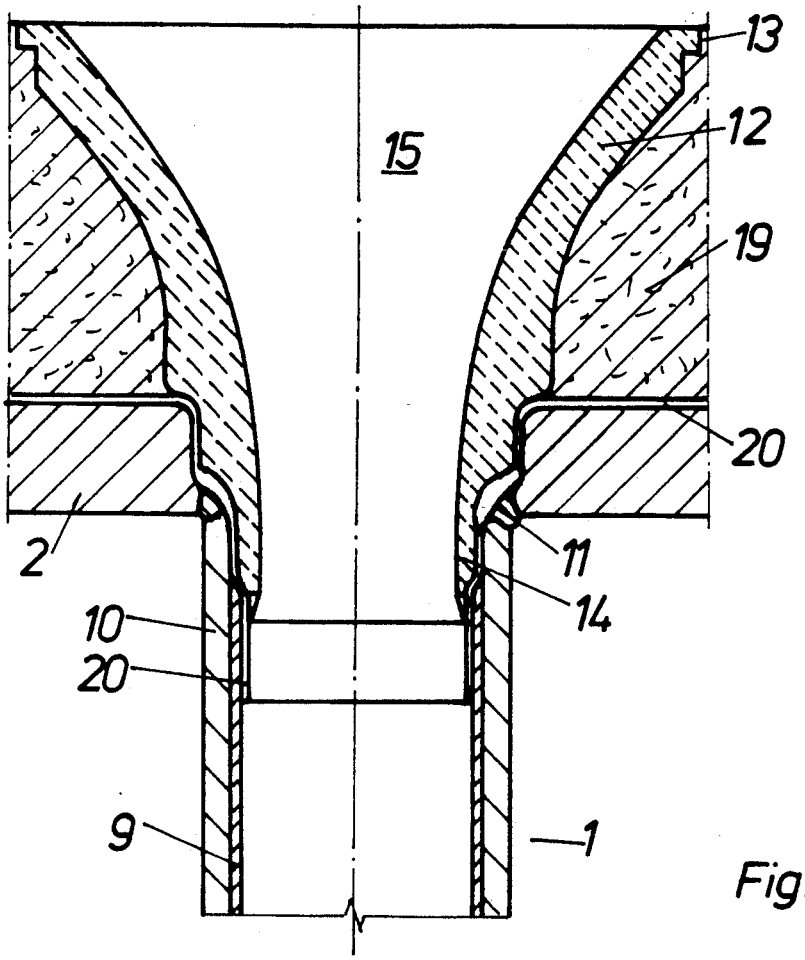
FIG. 3 represents the detail Z in FIG. 1.
Figure 4:
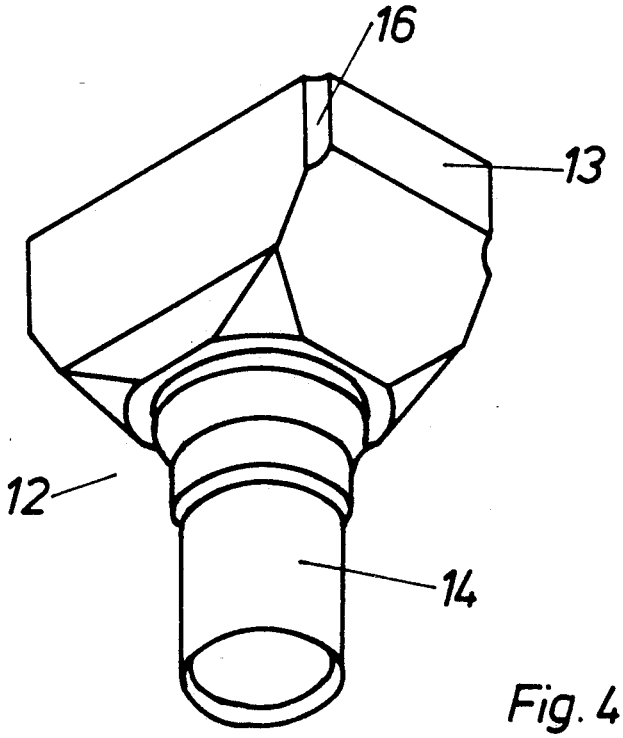
FIG. 4 is a perspective view of a single socket.

In the embodiment shown in FIG. 3, the sockets 12 have adjacent edges which are separated from the piping slab 2, so that an empty space is left between the bottom of the socket edges and the top of the slab. This space is filled with ceramic wool 19.

We claim:

1. A heat exchanger for cooling synthetic gas generated in a coal-gasification plant, comprising: heat transfer pipes conducting synthetic gas therethrough; a first tube sheet and a second tube sheet secured to said pipes for holding said pipes; a jacket surrounding said pipes; a layer of ceramic flooring on said first tube sheet for protecting said first tube sheet against elevated temperature effects; said first tube sheet being a gas intake-end tube sheet; said ceramic flooring comprising block-shaped sockets, each of said sockets having an opening tapering conically and narrowing into a pipe section extending into one of said pipes; said sockets having edges separated by a space from said first tube sheet; said space being between a bottom of said socket edges and a top of said first tube sheet; and ceramic wool filling said space.

2. A heat exchanger as defined in claim 1, wherein said sockets are arranged next to each other and having outer edges abutting against each other; said sockets having a quadrant-shaped outer contour with corners formed by rim recesses of the abutting sockets; and a bolt guided through said recesses and secured to said first tube sheet.

3. A heat exchanger as defined in claim 1, wherein said first tube sheet and an intake end of said pipes with a side facing said sockets have a coating of a metallic layer and a ceramic layer.

4. A heat exchanger as defined in claim 3, wherein said coating extends into said intake end of said pipes beyond said socket pipe section.

5. A heat exchanger as defined in claim 1, wherein said heat transfer pipes comprise a composite of an inner pipe resistant to high temperature corrosion and an outer pipe surrounding closely said inner pipe.

6. A heat exchanger for cooling synthetic gas generated in a coal-gasification plant, comprising: heat transfer pipes conducting synthetic gas therethrough; a first tube sheet and a second tube sheet secured to said pipes for holding said pipes; a jacket surrounding said pipes; a layer of ceramic flooring on said first tube sheet for protecting said first tube sheet against elevated temperature effects; said first tube sheet being a gas intake-end tube sheet; said ceramic flooring comprising block-shaped sockets, each of said sockets having an opening tapering conically and narrowing into a pipe section extending into one of said pipes; said sockets being arranged next to each other and having outer edges abutting against each other; said sockets having a quadrant-shaped outer contour with corners formed by rim recesses of the abutting sockets; a bolt guided through said recesses and secured to said first tube sheet.

7. A heat exchanger for cooling synthetic gas generated in a coal-gasification plant, comprising: heat transfer pipes conducting synthetic gas therethrough; a first tube sheet and a second tube sheet secured to said pipes for holding said pipes; a jacket surrounding said pipes; a layer of ceramic flooring on said first tube sheet for protecting said first tube sheet against elevated temperature effects; said first tube sheet being a gas intake-end tube sheet; said ceramic flooring comprising block-shaped sockets, each of said sockets having an opening tapering conically and narrowing into a pipe section extending into one of said pipes; said sockets being arranged next to each other and having outer edges abutting against each other; said sockets having a quadrant-shaped outer contour with corners formed by rim recesses of the abutting sockets; a bolt guided through said recesses and secured to said first tube sheet; an intake end of said pipes having a side facing said sockets and having a coating of a metallic layer and a ceramic layer on said side and extending into said intake end of said pipes beyond said socket pipe section; said first tube sheet having also a coating of a metallic layer and a ceramic layer; said heat transfer pipes being a composite of an inner pipe resistant to high temperature corrosion and an outer pipe surrounding closely said inner pipe.

* * * * *